US007886390B2

(12) United States Patent
Christ et al.

(10) Patent No.: US 7,886,390 B2
(45) Date of Patent: Feb. 15, 2011

(54) METHOD AND APPARATUS FOR WET-PROCESSING STRAND-SHAPED TEXTILE GOODS

(75) Inventors: Wilhelm Christ, Michelbach an der Bilz (DE); Tak Ming William Tsui, Causeway Bay (HK)

(73) Assignee: THEN Maschinen GmbH, Schwabisch Hall (DE)

( * ) Notice: Subject to any disclaimer, the term of this patent is extended or adjusted under 35 U.S.C. 154(b) by 403 days.

(21) Appl. No.: 12/148,380

(22) Filed: Apr. 18, 2008

(65) Prior Publication Data

US 2008/0263782 A1 Oct. 30, 2008

(30) Foreign Application Priority Data

Apr. 24, 2007 (DE) ..... 10 2007 019 217

(51) Int. Cl.
*D06B 11/00* (2006.01)

(52) U.S. Cl. ..... 8/149; 68/177; 68/178; 68/179

(58) Field of Classification Search ..... 8/149; 68/177, 178

See application file for complete search history.

(56) References Cited

U.S. PATENT DOCUMENTS

2006/0150343 A1* 7/2006 Christ ..... 8/149.1
2007/0137562 A1* 6/2007 Cordes et al. ..... 118/325

FOREIGN PATENT DOCUMENTS

| | | | |
|---|---|---|---|
| DE | 696 05 007 | T2 | 6/2000 |
| DE | 103 49 374 | A1 | 6/2005 |
| DE | 601 09 225 | T2 | 8/2005 |
| DE | 10 2005 022 453 | B3 | 11/2006 |
| EP | 1 526 205 | A2 | 4/2005 |
| EP | 1 672 111 | A2 | 6/2006 |

OTHER PUBLICATIONS

Communication from German Patent Office dated Jan. 17, 2008 regarding corresponding German Patent Application No. 10 2007 019 217.9 and English translation thereof.

Communication from European Patent Office dated Aug. 4, 2008 regarding corresponding European Patent Application No. 08102263.4-2314 and English translation thereof.

* cited by examiner

*Primary Examiner*—Michael Cleveland
*Assistant Examiner*—Samuel A Waldbaum
(74) *Attorney, Agent, or Firm*—Holtz, Holtz, Goodman & Chick, PC

(57) ABSTRACT

An apparatus for wet-processing strand-shaped textile good, includes a closed container, a transport nozzle array to which a gaseous transport medium can be supplied, and a device for applying a liquid treatment agent in atomized form to the moving strand of goods in the region of the transport nozzle arrangement. The device for the application of the treatment agent is designed to apply the treatment agent to the strand of goods in two sections (I, III), which are at a distance from each other in transport direction of the strand of goods, in a form enclosing the strand of goods at least partially in a ring-shaped manner. In so doing, the gaseous transport medium is applied to the strand of goods in an intermediate region (II) located between said two sections.

28 Claims, 8 Drawing Sheets

METHOD AND APPARATUS FOR WET-PROCESSING STRAND-SHAPED TEXTILE GOODS

Figure 1:
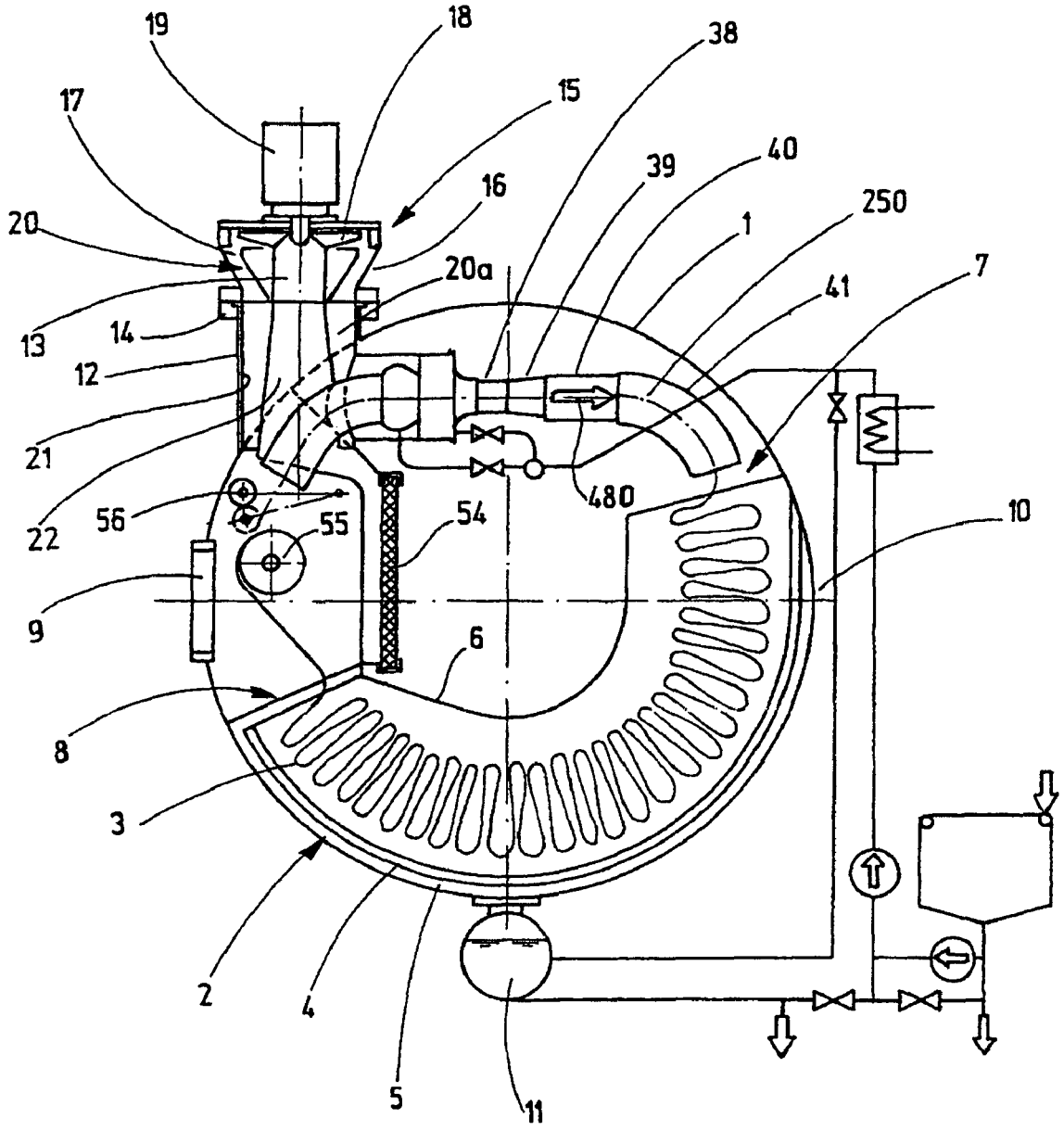

The invention relates to an apparatus for wet-processing strand-shaped textile goods, said apparatus comprising a closed container, comprising a transport nozzle array to which a gaseous transport medium can be supplied, said gaseous transport medium acting on the textile goods having the form of a strand of goods that can be transported through the transport nozzle array and through said container, and comprising a device for applying a liquid treatment agent in atomized form to the moving strand of goods in the region of the transport nozzle arrangement.

Furthermore, the invention relates to a method for wet-processing strand-shaped textile goods, said method being used to move the strand of goods through a transport nozzle array to which a gaseous transport medium is supplied, said strand of goods being transported in said transport nozzle array in one direction of transport.

Considering aerodynamic piece-dyeing machines operating by the jet principle, in which the treated piece goods are present in the form of a strand, the transport of the strand-shaped piece goods is achieved by means of a gas stream that is generated by a blower and supplied to a transport nozzle array that comprises a Venturi transport nozzle with an annular gap, i.e., a so-called jet apparatus. These aerodynamic piece-dyeing machines are contrasted with the also known hydraulic piece-dying machines, in which the treatment bath effects the transport of the material strand, whereby said treatment bath, at the same time, is used as the carrier of treatment bath additives such as dyes or auxiliary agents and chemicals.

Examples of jet-processing machines operating by the principle of aerodynamics are disclosed by the following references, to name a few examples: EP 0078022 B2, DE 41 19 152 C2, DE 197 28 420 D2, DE 199 24 743 A1, EP 1526205 A2, DE 10349374 A1 and DE 199 24 180 A1.

Considering the different embodiments of jet-processing machines known from these literature references, the delivery of the gas stream effecting the transport of the strand of goods occurs in the housing of the respective transport nozzle. Apart from this feature that exists in almost all such machines, the location of the transport nozzle within the machine system varies. The transport nozzle may be upstream a driven or an idling deflecting roller, or the deflecting roller may be equipped with a drive as well as with a free-wheel system.

The application of the treatment agent to the strand of goods occurs in the most diverse ways:

Referring to the jet-dyeing plant in accordance with EP 0078022, the treatment agent is simultaneously added in atomized form in the region of the jet section in order to drive the goods. Referring to the wet-processing device for textile goods known from DE 41 19 152 C2, the treatment agent (treatment bath) is delivered only in the entry region of the goods storage space, i.e., on the upper and lower sides of the moving strand of goods. Referring to a nozzle unit for the transport of a strand of textile material as described in DE 197 28 420 C2, the exit region of a textile strand sliding device, located downstream of one of the nozzle bodies and being pivotable in the transport plane, is provided with a bath delivery device, whereby one or more of the outlet orifices directed at the textile strand are arranged so as to achieve a jet-shaped delivery of the bath in the region of the rear end of the textile strand sliding device. Referring to a wet-processing device operating by a similar principle in accordance with DE 199 24 180 A1, viewed in transport direction of the continuous rope of hose-shaped material, an injection devices for the treatment bath is arranged directly upstream of and/or downstream of the transport device that is configured as a gas nozzle, said injection device being connected to the bath circulation system. Only the arrangement of two injection devices downstream of the gas nozzle, said injection devices injecting the treatment bath on the underside of the strand of goods, is explained in detail, so that the introduction of the treatment bath is achieved, respectively, via a bath jet on which the strand-shaped hose material is sliding. Document DE 199 24 743 A 1 describes a similar arrangement where a fluid nozzle supplied with the bath fluid is arranged underneath the transport section in the transport direction of the strand of goods. From document EP 156205 it has been known to apply the treatment agent to the moving strand of goods with an amount of treatment agent per unit of time, controlled as a function of time, whereby the control of the amount of treatment agent applied per unit of time to the strand of goods is achieved by control of the pump means and/or the valve means associated therewith. The delivery of the treatment agent itself occurs into the Venturi transport nozzle in the region of its annular gap and/or, respectively viewed in transport direction of the strand of goods, in the region upstream or downstream of the transport nozzle. Finally, referring to a wet-processing machine for strand-shaped textile goods known from DE 103 49 374 A1, the means for the application of a treatment bath to the strand of goods are provided in a section of the advance path of the strand of goods between a winch upstream of a Venturi transport nozzle and the annular gap of the nozzle of the transport nozzle system. By wetting the strand of goods upstream of the transport nozzle the proportion of bath to be introduced into the transport nozzle is to be reduced. Means for the injection of treatment bath into the passage channel of the nozzle cone of the transport nozzle may be provided, said means terminating all around the channel wall limiting the passage channel, so that said means dispensing the treatment bath into the passage channel have a moving component in advance direction of the goods.

The different modifications of the type of treatment agent application to the strand of goods, as have been briefly explained above, show that very different ideas regarding the type and method of a practicable application of the treatment agent to the strand of goods exist in the world of those skilled in the art. This results in the object to be achieved by the invention, namely, to provide a jet-processing apparatus for strand-shaped textile goods, said apparatus permitting the treatment of a large section of product having different strand weights and different strand volume, and consisting of natural and synthetic fiber materials, under optimal processing conditions. In so doing, an optimal transfer of the flow energy of the gaseous transport medium, which, optionally, also acts as the treatment agent, and of the liquid treatment agent to the strand of goods in the transport nozzle array is to be ensured, i.e., without the occurrence of any disadvantageous influence of the surface of the textile goods. At the same time, however, it is also necessary to ensure that a uniform distribution of the treatment agent on the strand of goods be ensured.

This object is achieved with an apparatus in accordance with the invention, said apparatus displaying the features as in patent claim 1. A corresponding inventive method for wet-processing the textile goods is the subject matter of claim 27.

The apparatus in accordance with the invention comprises a device for the application of a liquid treatment agent in atomized form to the moving strand of goods in the region of the transport nozzle array. This device for the application of the treatment agent is designed to apply the treatment agent to the strand of goods in two sections that are at a distance from each other in transport direction of the strand of goods in a form enclosing the strand of goods at least partially in a ring-shaped form, and whereby, in an intermediate region located between the two sections, the gaseous transport medium is applied to the strand of goods.

Due to the divided delivery of the treatment agent (treatment bath) and of the transport gas stream to the strand of goods, an optimal transfer of the flow energy of the transport gas stream to the strand of goods, on the one hand, and an optimal distribution of the treatment agent in two sections that are separate from the region of action of the gas transport stream, on the other hand, are achieved. Inasmuch as the application of the treatment agent in the two sections occurs so as to at least partially enclose the strand of goods in ring-shaped form, an additional centering of the strand of goods on the axis of the transport nozzle array is achieved in these sections independent of the strand volume. At the same time, the annular, i.e., all-side, wetting of the strand of goods with the treatment agent ensures a highly uniform application of the treatment agent to the strand of goods and thus an optimal treatment result. An optimal distribution of treatment agent is achieved in the transport nozzle array itself, in which case simple measures may be used to allow an adaptation to the respectively required operating conditions.

Referring to the inventive method for wet-processing strand-shaped textile goods, during passage through the transport nozzle array, atomized liquid treatment agent is applied to the moving strand of goods in two divided sections, which are at a distance from each other in transport direction, in a form that at least partially encloses the strand of goods, while, at the same time, a transport medium is applied to the strand of goods in an intermediate region located between said two sections, said transport medium effecting the advance of the strand of goods.

Modifications of the new apparatus and the new method are the subject matter of subclaims.

Figure 2:
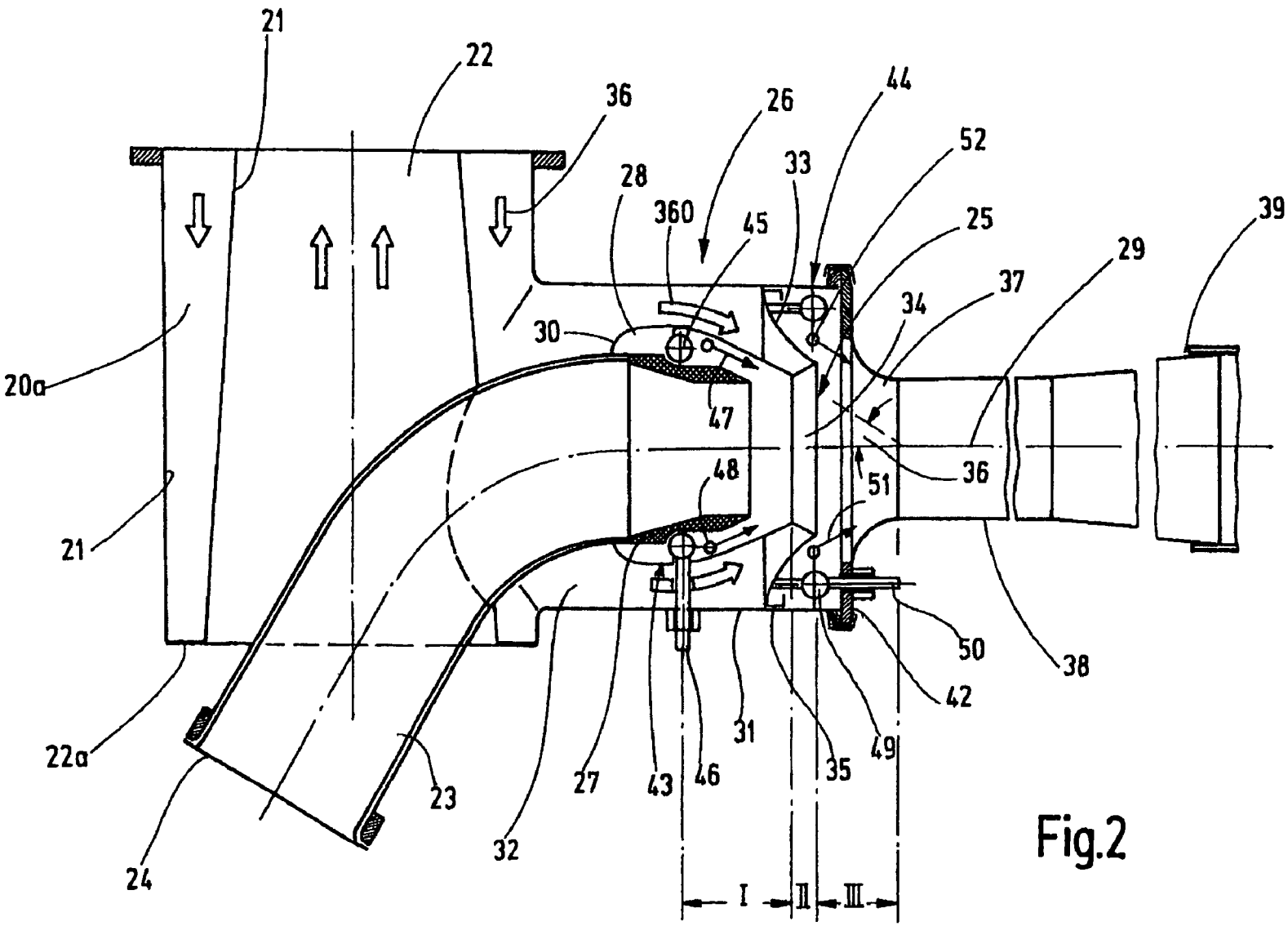
Figures 3, 3A, 4, 4A:
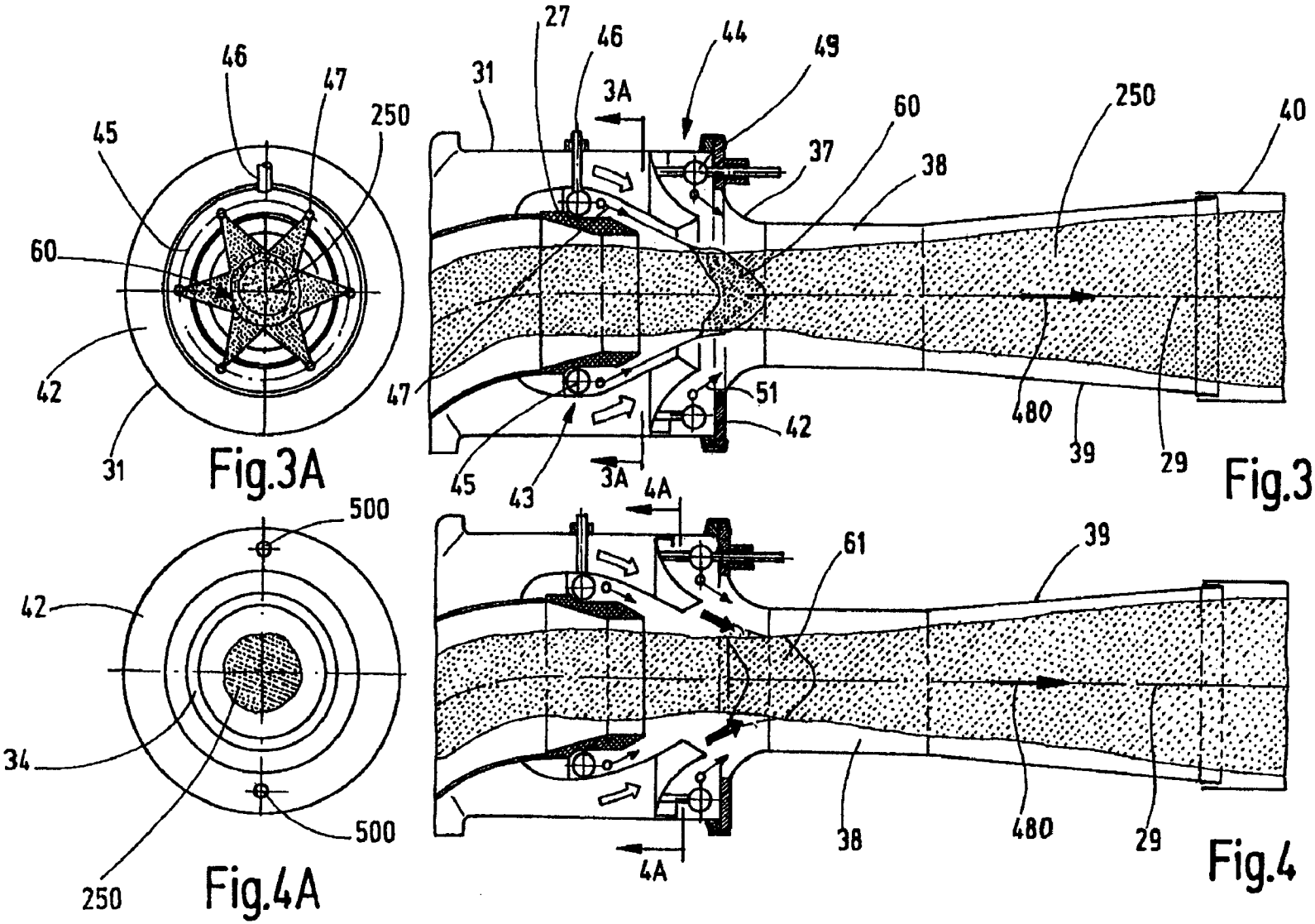
Figure 5:
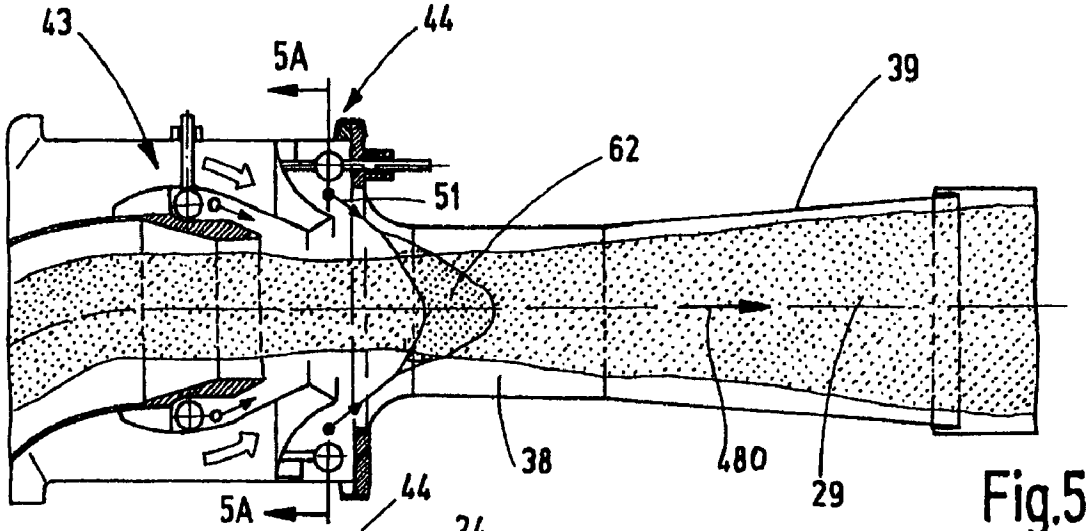
Figure 5A:
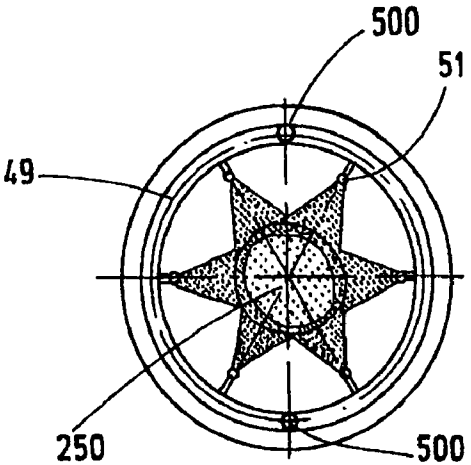
Figure 6:
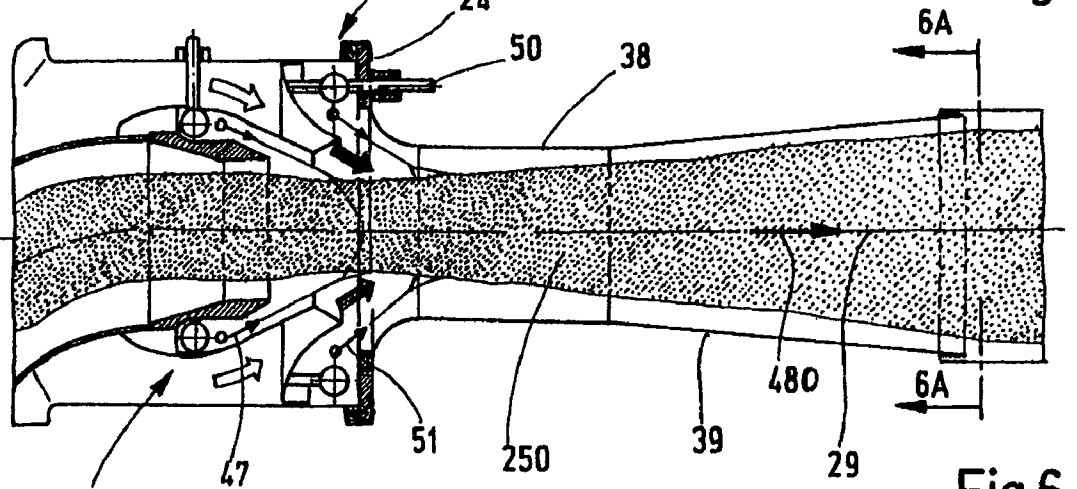
Figure 6A:
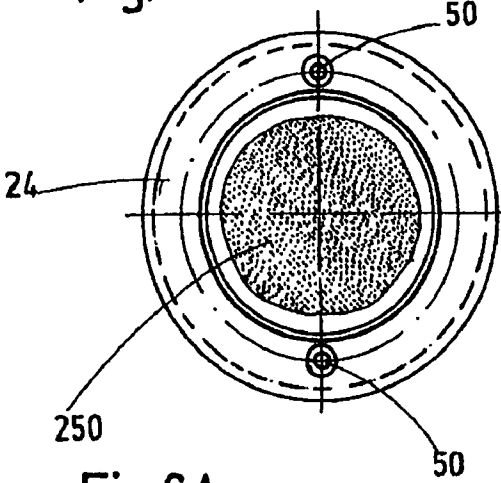
Figure 8:
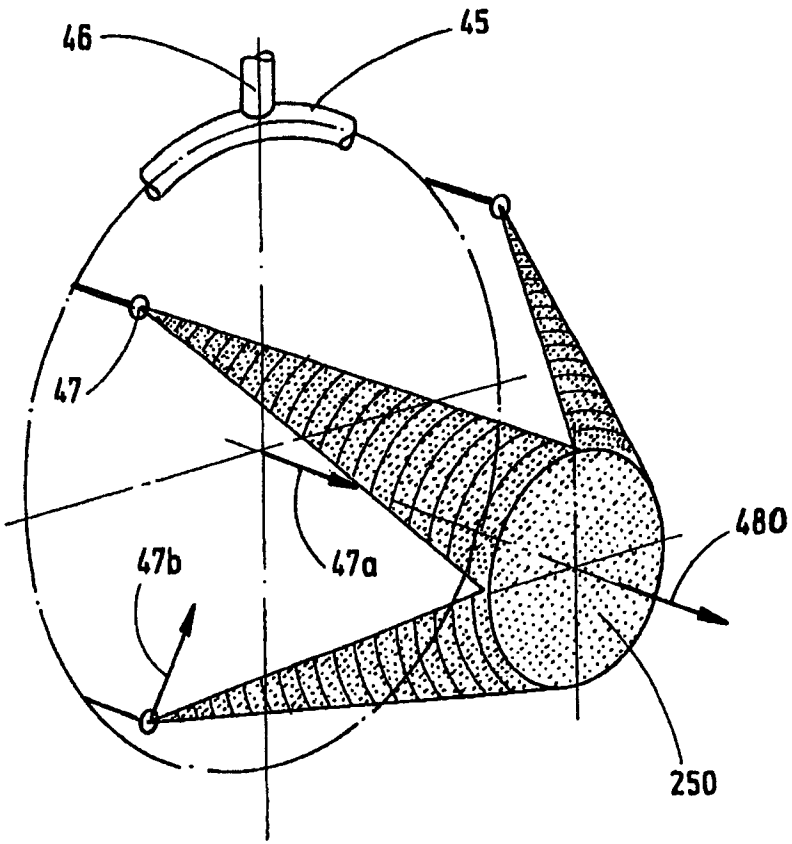
Figure 7:
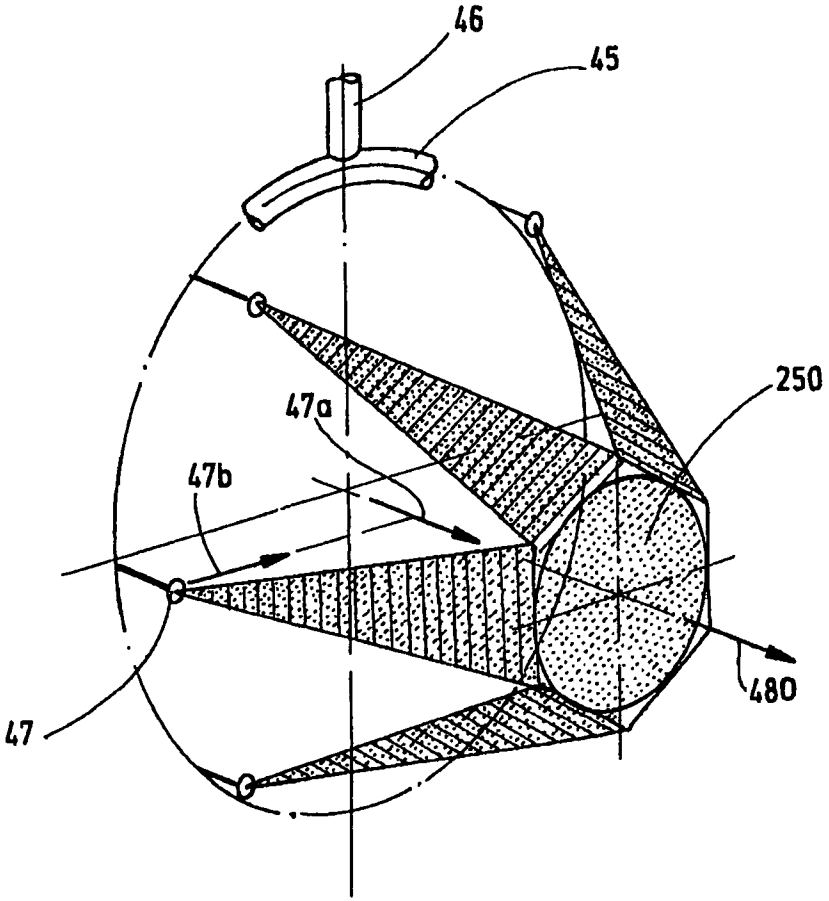
Figure 9:
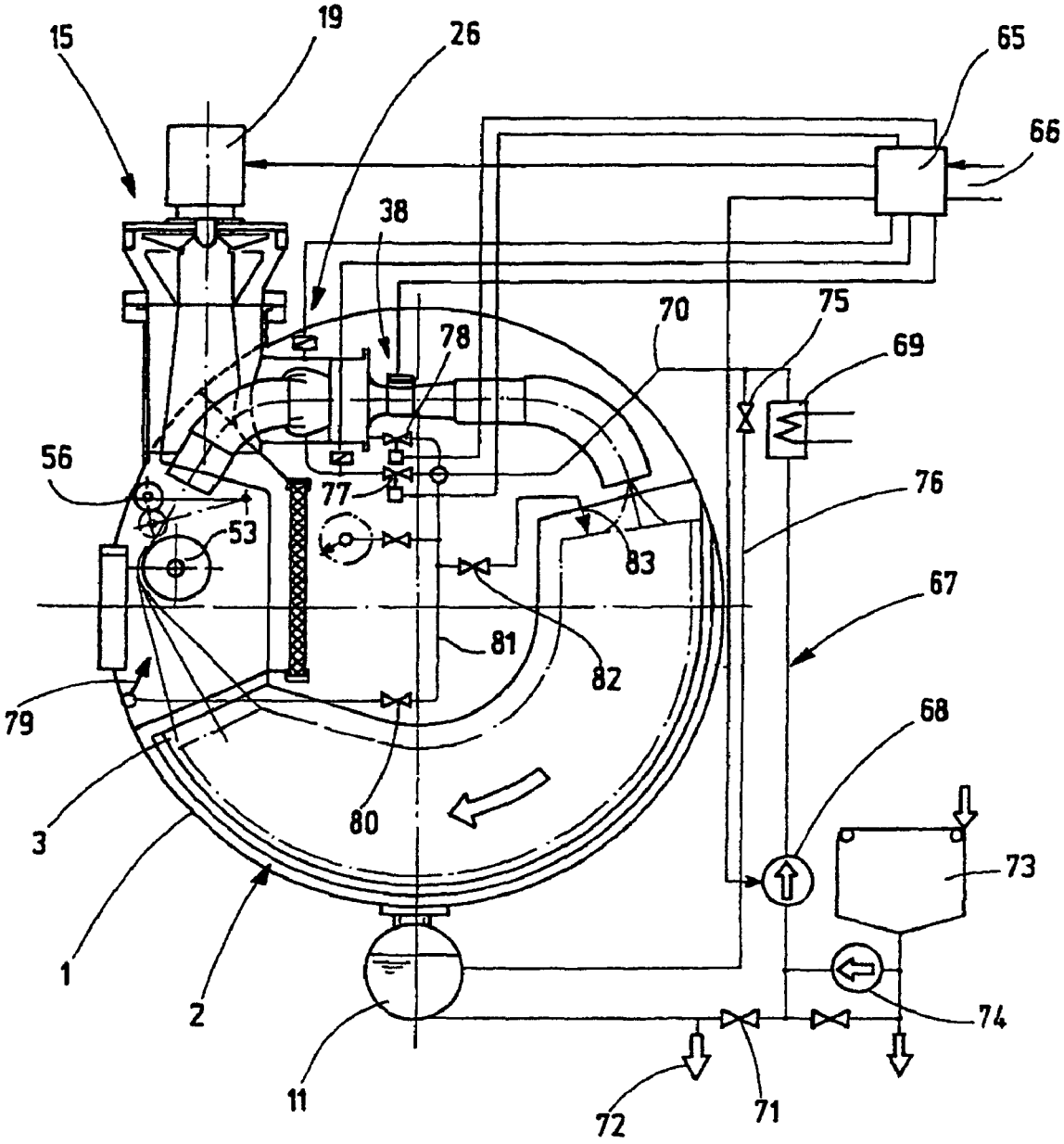
Figure 10:
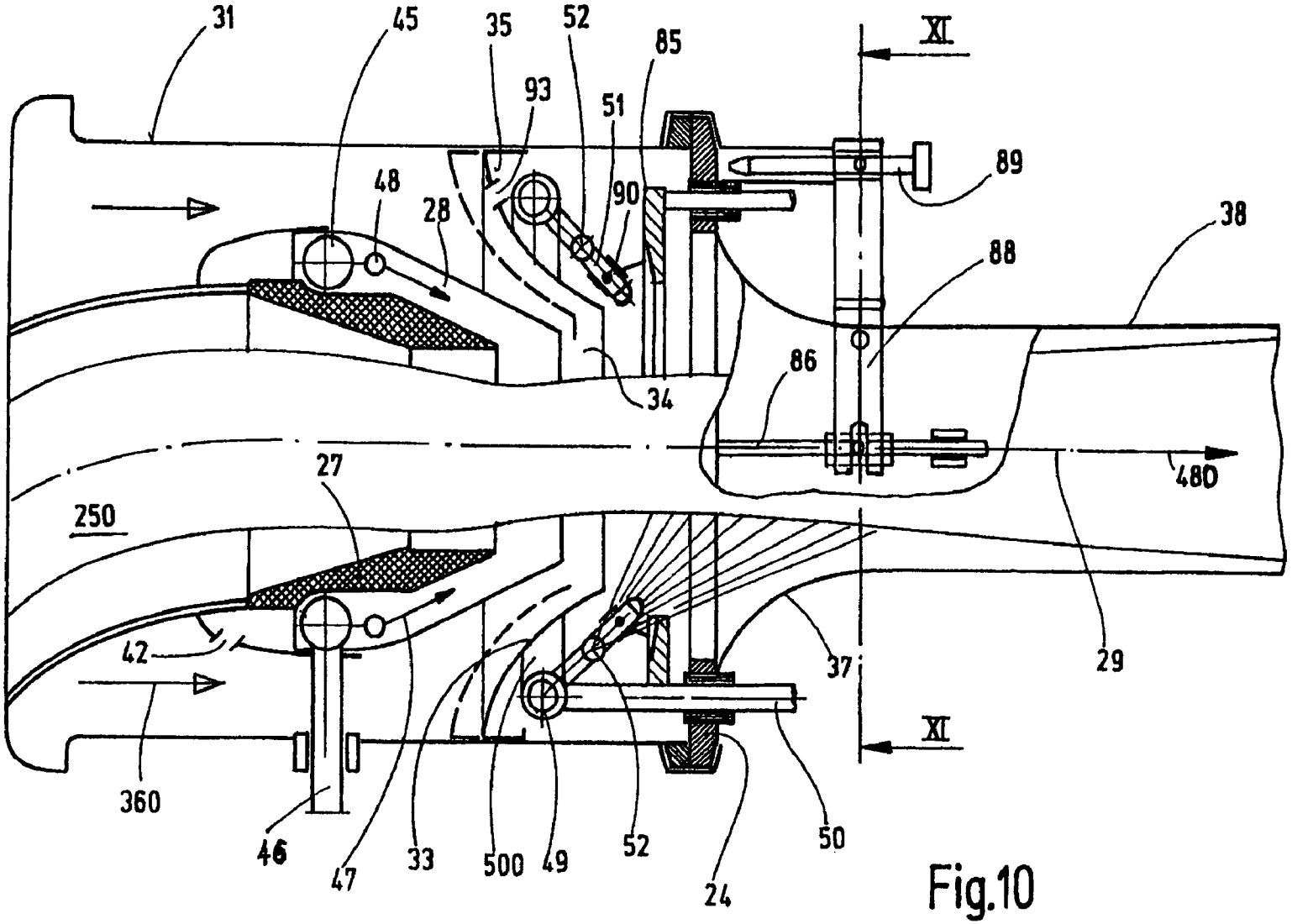
Figure 12:
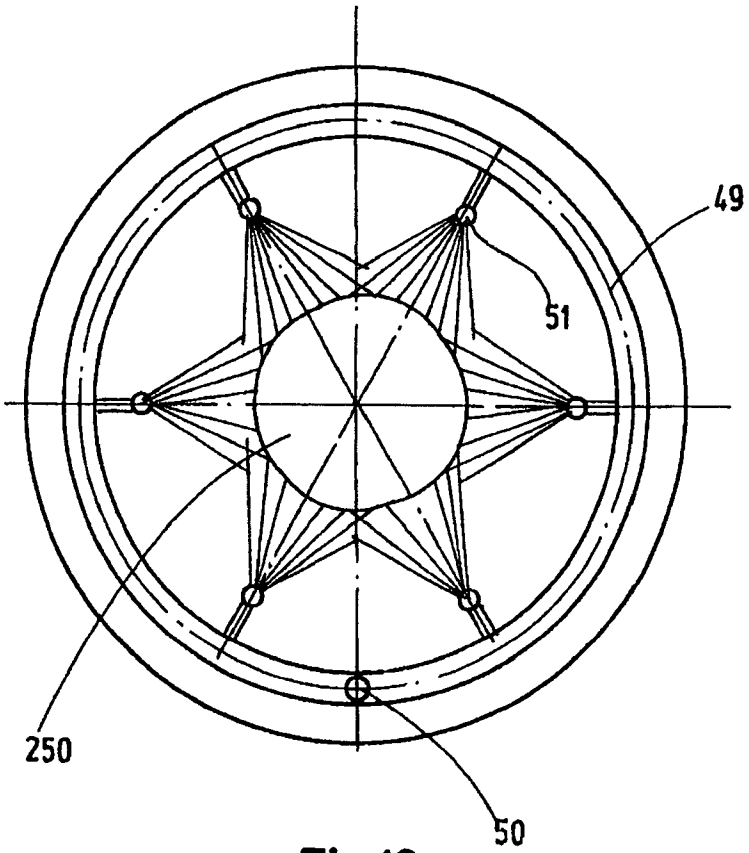
Figure 11:
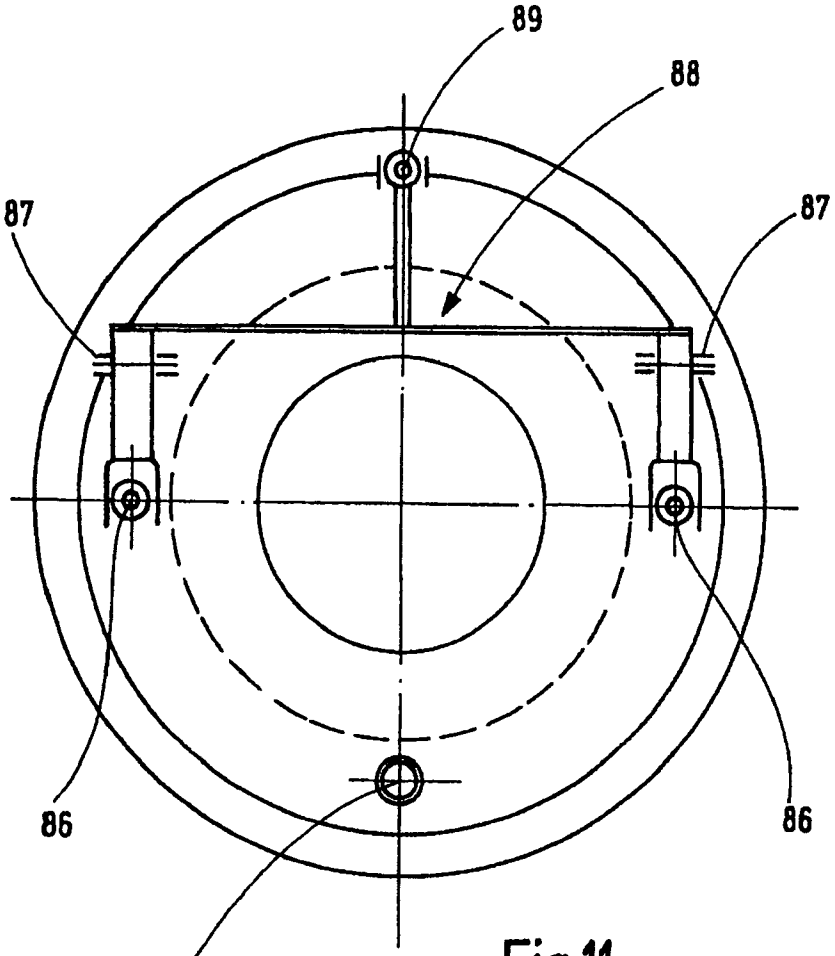

The drawings show exemplary embodiments of the subject matter of the invention. They show in FIG. 1 a schematic view, in cross-section and in side elevation, of an apparatus in accordance with the invention, embodied as a high-temperature piece-dyeing machine;

FIG. 2 a longitudinal section, in side elevation and on a different scale, of the transport nozzle array of the apparatus in accordance with FIG. 1;

FIG. 3 a schematic view in a corresponding longitudinal section of the transport nozzle array in accordance with FIG. 2, said view also showing the distribution of the treatment bath from the jet region of the first section of the strand of goods;

FIG. 3A the array in accordance with FIG. 3, in section along the line 3A-3A of FIG. 3, showing the annular region of action of the jet nozzles acting on the strand of goods in the first section of application of the treatment bath while the strand of goods is centered at the same time;

FIG. 4 a corresponding view, in longitudinal section, of the array in accordance with FIG. 3, showing the distribution of the treatment bath from the jet region of the first section, subject to the action of the transport gas stream;

FIG. 4A a side elevation, in longitudinal section along line 4A-4A of FIG. 4, showing the strand of goods in the intermediate region between the two sections of application of the treatment bath to the strand of goods;

FIG. 5 a corresponding view, in longitudinal section, of the array in accordance with FIG. 2, showing the annular region of action of the jet nozzles acting on the strand of goods in the second section of application of the treatment bath while the strand of goods is centered at the same time;

FIG. 5A a sectional view, along line 5A-5A of FIG. 5, of the array in accordance with FIG. 2, showing the region of action enclosing the jet nozzles of the second section;

FIG. 6 a corresponding view, in longitudinal section, of the array in accordance with FIG. 2, showing the opening of the hose-shaped strand of goods with a schematic view of the treatment bath distribution within the strand of goods;

FIG. 6A a side elevation, longitudinally in section along line 6A-6A of FIG. 6, showing the treatment bath distribution within the strand of goods;

FIG. 7 a perspective, schematic view, illustrating, schematically, the treatment bath delivery and the treatment bath application to the strand of goods in the first section of treatment bath application with the use of six flat-jet nozzles;

FIG. 8 a perspective, schematic view similar to FIG. 7, illustrating, schematically, the treatment bath supply and treatment bath application to the strand of goods in the first section of treatment bath application with the use of four jet nozzles configured as arc segments;

FIG. 9 a sectional view corresponding to FIG. 1, of the device in accordance with FIG. 1, illustrating, schematically, the main control and regulating devices;

FIG. 10 a sectional view in accordance with FIG. 2 of the transport nozzle array as in FIG. 2, in a modified embodiment comprising an adjustable annular nozzle gap for the transport gas stream and comprising an adjustment mechanism for the jet angle of the jet nozzles in the second section of application of the treatment bath to the strand of goods;

FIG. 11 a sectional side view, along line XI-XI of FIG. 10, of the array as in FIG. 10; and FIG. 12 a sectional view in accordance with FIG. 5A of the region of action of the jet nozzles on the strand of goods in the second section of application of the treatment bath to the strand of goods.

FIG. 1 shows an embodiment of an apparatus in accordance with the invention configured as a high-temperature piece-dyeing machine as is described, in view of its fundamental construction, in the applicant's document DE 10 2005 022 B3. Reference is made to this document regarding a more detailed description of the components of this piece-dyeing machine that are not essential to the present invention.

The piece-dyeing machine comprises a treatment container 1 configured as a cylindrical vat, said container being closed in a pressure-tight manner on both end faces by welded-on torispherical heads. As a rule, the treatment container 1 contains several axially adjacent goods storage spaces as are described in said cited document, only one of said storages spaces being shown in cross-section in the section of the piece-dyeing machine depicted in FIG. 1. The goods storage space that is generally marked by reference number 2 is limited by two parallel lateral walls 3, only one of them being shown in FIG. 1, and by one bottom wall 4, said bottom wall being connected to the lateral walls 3. The bottom wall 4 is designed as a sliding bottom by means of parallel FTFE rods or by being lined with FTFE tiles in a manner known per se, whereby both embodiments permit an outflow of excess treatment bath into the space 5 underneath the bottom wall 4 in the treatment container 1. The lateral walls 3, also referred to as the goods storage space limiting walls, have on their inside respectively one PTFE coating or are configured as solid tile components in such a manner that, as in the case of the bottom wall 4, a friction-reducing setup is achieved. An inner covering 6 is connected to the lateral walls 3, so that the goods storage space has an essentially U-shaped configuration with a goods strand inlet opening 7 and a goods strand outlet opening 8. The goods storage spaces 2 in the treatment container 1, as a rule, have respectively the same axial goods storage space width, said width being potentially typically 800 mm or more with a treatment space diameter of approximately 2250 mm.

Leading into each goods storage space 2 is a loading and unloading opening that is closed with a removable pressure-tight closure 9, said opening being located approximately at the level of the horizontal diameter plane 10 of the treatment container 1. On the underside of the treatment container 1 is a bath collection container 11 which is connected to the inside space of the container and is designed for the collection of the treatment agent (bath) draining off the textile goods. The volume of the bath collection container 11 is such that the total bath quantity, minus the percentage of bath carried by the textile goods, can be collected, without the goods that are being moved in the respective goods storage space coming into contact with a bath level outside the goods.

At a distance from the goods strand outlet opening 8 of the respective goods storage space located below the diameter plane 10, each goods storage space 2 has, leading into the inside of said storage space, a cylindrical connecting piece 12 welded to the barrel of the treatment container 1, said connecting piece being in vertical alignment with the axis 13 and being located in the central plane of symmetry of the goods storage space 2. The connecting piece 12 is provided with an annular flange 14 on the one end and has a blower unit 15 attached to said annular flange. The blower unit 15 has an upper housing part 16 with an impeller housing 17 containing a radial blower impeller 18 that revolves about a rotary axis that is coaxial with the axis 13 of the connecting piece 12 and that is coupled with an electric motor 19 that is set on the upper housing part 16. The electric motor 19 is a speed-controllable three-phase motor for operation that is designed to control the respectively required transport gas conveyor stream. The gaseous medium that is transported by the blower impeller 18 is rerouted into an outer flow channel 20 that is coaxial with the axis 13, said channel establishing a pressure-side connection to the impeller housing 17.

Rotatably supported inside the connecting pipe 12 is a cylindrical inner jacket 21 forming part of the underside of the housing of the blower unit 15 and being set in at a small radial distance, said inner jacket being aligned coaxially with the axis 13. The inner jacket 21 is sealed laterally against the annular flange 14 via a seal that is configured, for example, as a labyrinth seal or as a grooved sleeve and is mounted so as to be rotatable in axial direction on the annular flange 14 via an appropriate profile and so as to be axially suspended. Coaxially with respect to the axis 13, there extends, inside the inner jacket 21, an internally arranged flow channel 22 provided with an intake cone, said flow channel leading as an intake channel to the blower impeller inlet and forming the intake piece and terminating, at its opposite end, inside the treatment container 1. On its outside, the inner coaxial flow channel 22 limits, together with the inner jacket 21, a cylindrical extension 20*a* of the outer flow channel 20. In so doing, the blower unit 15 contains two concentrically arranged vertical flow channels 20, 20*a*; 22, whereby the flow channel 22 acting as the intake channel widens conically toward the inner space of the container and is closed at the bottom at 22*a* with respect to the inner jacket 21, as is also obvious from FIG. 2, in particular.

The blower unit 15 may be removed from the annular flange 14 as a whole and, if necessary, may be replaced with a blower unit featuring a different output or different transport characteristics.

The tube-shaped goods strand inlet part 23 (FIG. 2) of a transport nozzle 25 configured as an annular Venturi nozzle of a transport nozzle array generally labeled 26 is non-rotationally connected with the rotatably supported inner jacket 21 and the coaxial flow channel 22 that is rigidly connected to said inner jacket. The goods strand inlet part 23 that is essentially configured as a 60°-degree pipe bend has a goods strand inlet opening 24, which is located at the greatest-possible distance from the container diameter plane 10 (FIG. 1) in order to ensure a favorable removal angle of the continuous strand of goods—as indicated in FIG. 1 at 250—out of the goods strand outlet opening 8 of the goods storage space 2 and in order to create room for the goods strand sliding devices. The goods strand inlet part 23 leads to an inlet nozzle part 27 of the Venturi transport nozzle 25 that may also be referred to as a jet apparatus. Connected, in a sealed manner, with the tube-shaped goods strand inlet part 23 is an inflow jet nozzle formed part 28 having essentially the shape of a circular truncated cone, said inlet jet nozzle formed part being coaxial with the outlet-side transport nozzle axis 29 and enclosing the inlet nozzle part 27 at a radial distance. The inlet jet nozzle formed part 28 is configured, on its outside, so as to promote the flow and is welded at 30—by a rounded, adjoining closing part—to the goods strand inlet part 23 so as to create a seal. Alternatively, the inflow jet nozzle formed part 28 could also be connected to the inlet nozzle part 27.

The inflow nozzle formed part 28 and the inlet nozzle part 27 are enclosed by a cylindrical nozzle housing 31 that is coaxial with respect to the transport nozzle axis 29, said nozzle housing's inside wall extending at a radial distance from the nozzle formed part 28 and being connected in a sealed manner with the inner jacket 21. The goods strand inlet part 23 and the inflow nozzle formed part 28 thus, in a manner as is obvious from FIG. 2, limit, together with the transport nozzle housing 31, a transport medium inflow channel 32 which is connected to the pressure channel 20*a* of the blower unit 15.

Arranged inside the cylindrical transport nozzle housing 31 is a laterally sealed, essentially funnel-shaped or trumpet-shaped, outer nozzle formed part 33, said part limiting, together with the inflow nozzle molded part 28, a guide channel that is coaxial to the transport nozzle axis 29 and has an annular gap 34. The guide channel and the annular gap 34 are thus connected—via the pressure channels 20*a*, 32—to the pressure side of the blower unit 15, and the transport gas stream indicated by arrows 360 in FIG. 2 is applied from the direction of said side. The radial width of the guide channel and its annular gap 34 may be changed by axially shifting the outer nozzle formed part 33 in the transport nozzle housing 31 and may be adjusted to the respectively most favorable operation conditions, as will be later explained in greater detail with reference to FIG. 10. Both nozzle formed parts 28, 33 are, e.g., formed parts of sheet metal fabricated of sheet steel or of synthetic material, and have an outer nozzle formed part 33 with a laterally adjoining outside flange 35, with which it is sealed in an axially adjustable manner with respect to the inside wall of the transport nozzle housing 31. Both nozzle formed parts 28, 33 are configured in such a manner that, as indicated in FIG. 2 at 36, the respectively desired jet angle of the Venturi transport nozzle 25 with the transport nozzle axis 29 is achieved. As a rule, this jet angle is within the range of 10° to 30°, preferably 15° to 25°. If necessary, said angle may also be adjustable by appropriately configuring the nozzle molded parts 28, 33.

Adjoining the annular gap 34 at an axial distance, extending coaxially with respect to the transport nozzle axis 29, is an essentially funnel-shaped inlet part 37 for an adjoining, essentially cylindrical mixing zone 38 for the treatment agent or bath streams and for the transport gas stream, said section terminating in a downstream diffuser 39. Adjoining the diffuser 39 is a coaxial transport pipe 40 having a larger diameter (FIG. 1), said pipe, in turn, terminating in an outlet bend 41 having a larger diameter, whereby said outlet bend, together with the transport pipe 40, forms a transport zone and is able to feed the exiting strand of goods 250 into the storage inlet opening 7. As is obvious from FIG. 1, the outlet bend 41 terminates at a minimal distance above the edge of the inlet opening 7, whereby said bend is aligned approximately parallel with respect to the side of the opening. The inlet part 37 of the mixing zone 38 is mounted to an annular plate 42 (FIG. 2) in a sealed manner, said annular plate being sealed and removably attached to the face end of the transport nozzle housing 31 by means of a flange.

Provided in the cylindrical transport nozzle housing 31 are two injection jet nozzle systems 43, 44 that are divided from each other and are arranged at an axial distance along the transport nozzle axis 29 and in a manner coaxial with respect thereto. The first injection jet nozzle system 43 comprises a cylindrical treatment agent or bath agent distributor ring 45 that is attached outside onto the inlet nozzle part 27 and is arranged in the space between the inflow nozzle formed part 28 and the nozzle inlet part 27. The bath distributor ring 45 has a sealed connecting piece 46 extending through the transport nozzle housing 31 toward the outside and supports, e.g., in the manner obvious from FIG. 3A, a number of fan-jet nozzles 47, namely six nozzles in the present—not restricted—exemplary embodiment, each of said fan-jet nozzles being respectively connected via a ball joint 48 with the bath distributor ring 45. The inflow nozzle formed part 28 shields the jet nozzles 46 radially toward the outside against the transport gas stream as indicated by the arrows 360 in FIG. 2, said jet nozzles spraying—at a pre-specified jet angle and in atomized form—the treatment agent (bath) delivered to them via the connecting piece 46 and the bath distributor ring 45 onto the strand of goods 250 exiting from the inlet nozzle part 27 before the strand of goods 250 exits the inflow nozzle formed part 28 and before the transport gas stream from the annular gap 34 is applied.

The jet angle subtended by the jet nozzles 47 and the transport nozzle axis 29 can be adjusted via the ball joints 48. As a rule, this angle is the same for all the jet nozzles 47 and is smaller than 90°. Preferably, its is within the range of 10° and 30°, in particular between 15° and 25°. Inasmuch as the vertex of the jet angle of the jet nozzles 47 is located in the transport direction of the strand of goods 250 indicated by arrow 480 in FIG. 1, the bath applied to the passing strand of goods 250 results in a component of force in the goods strand transport direction 480 that aids the transport of the strand of goods in FIG. 1 in clockwise direction. A second component of the jet nozzles 47 that are arranged in the form of a ring around the strand of goods 250 is directed in radial direction and attempts to center the passing strand of goods relative to the transport nozzle axis 29.

The described first injection jet nozzle system 43 is located in a first section I of the transport nozzle array 26, said section approximately extending from the bath distributor ring 45 up to the orifice of the inflow nozzle formed part 28 in the transport direction 480 of the strand of goods 250.

As is shown by FIG. 2, adjoining the first section I is a second section II or intermediate section in the transport nozzle array 26 in the transport direction 480, in which section II the transport gas stream exiting from the annular gap 34 is applied to the passing strand of goods 250.

Subsequently, the strand of goods 250 enters a third section III of the transport nozzle array 26, said section extending approximately between the outer nozzle formed part 33, i.e., from the limit of the annular gap 34 formed by said section up to the end of the mixing zone inlet part 37 in the transport direction 48. Arranged in this third section is the second injection jet nozzle system 44 which comprises a treatment agent or bath distributor ring 49 that is coaxial with respect to the transport nozzle axis 29, said ring being accommodated in the space enclosed by the outer nozzle formed part 33, the transport nozzle housing 31 and the annular plate 42 and, in the shown exemplary embodiment, having a larger diameter than the bath distributor ring 45 of the first jet nozzle system 43. The second bath distributor ring 49 is connected to an axially aligned connecting piece 50 for bath delivery, said connecting piece extending toward the outside, sealed by the annular plate 42, and, together with other devices that are not specifically shown in FIG. 2, acting as a support for the bath distributor ring 49. Via the connecting struts 500, the bath distributor ring 49 is connected to the outer nozzle formed part 33 that is laterally sealed in the transport nozzle housing 31 and is supported therein so as to be axially movable in such a manner that, due to an axial adjustment of the bath distributor ring 49, also the nozzle formed part 33 can be adjusted in axial direction, as will be later explained in detail with reference to FIG. 10.

Distributed around its circumference, the bath distributor ring 49 has a number of injection jet nozzles 51, said number of nozzles not being restricted to six in the present exemplary embodiment and each being connected with the bath distributor ring 49 via respective ball joints 52. The jet angle that is subtended by the jet nozzles 51 and the transport nozzle axis 29 can be adjusted via the ball joints 52. The jet angle is smaller than 90° and its vertex, as is obvious from FIG. 2, is aligned in such a manner that the bath jets exiting from the jet nozzles 51 transfers a component of force directed in the transport direction 480 of the strand of goods 250 to the passing strand of goods, said component of force contributing to the transport of the strand of goods in the transport direction 480. At the same time, the jet nozzles 51 that are distributed uniformly around the strand of goods produce components of force that act radially on the strand of goods, said components of force effecting, or at least contributing to, the centering of the strand of goods in the third section III relative the transport nozzle axis 29. The jet nozzles 51 of the second injection nozzle system 44 carry along the treatment agent (bath), also in atomized form, on the surface of the strand of goods, so that the strand of goods is enclosed by the application region in a ring-shaped manner.

The application of the treatment agent and the transport of the continuous strand of goods 250 passing through the transport nozzle array 26 take place in the so-far described transport nozzle array as follows:

Via a filter element 54 (FIG. 1) and through the flow channel 22, the blower unit 15 takes in gaseous transport medium (as a rule, an air/water vapor mixture) from the inside space of the container 1 and produces, on the pressure side, a transport medium stream that acts—via the flow channels 20*a*, 32—on the annular gap 34 of the transport nozzle, as is shown by the arrows 360 in FIG. 2. As a result of this, the continuous strand of goods 250 is circulated clockwise, referring to FIG. 1, whereby said strand of goods is taken continuously out of the goods storage space 2 through the goods strand outlet opening 8, is moved—via a deflecting roller 55 with an associated guide roller 56 that controls the looping angle and is pivotally supported—into the goods strand inlet part 23, is driven in the transport nozzle array 26 in the transport direction 480, and, after having passed through the transport nozzle array 26 and the transport section 40 and exiting from the outlet bend 41, is moved into the goods strand inlet opening 7 of the goods storage space 2 and, in so doing, cuttled at the same time in a manner known per se.

While the strand of goods moves through the transport nozzle array 26, the jet nozzles 47 that are uniformly distributed around the strand of goods apply—initially in section I (FIG. 2)—treatment bath to the moving strand of goods from all sides in a region of action enclosing the strand of goods in an annular manner, so that the circumferential surface of the passing strand of goods is uniformly wetted all around by the sprayed-on treatment bath. FIGS. 3, 3A, namely the schematic view of the first section, show this ring-shaped region of action. As is shown by FIG. 3, said region of action extends, in the transport direction 480, almost to the end of the inlet part 37 of the mixing zone 38. The axial length of the region of action 60 depends on the jet angle that is subtended by the jet nozzles 47 and the transport nozzle axis 29 and that can be adjusted for the required purpose depending on the operating requirements. The jet ranges extending from the individual jet nozzles and expanding fan-like toward the transport nozzle axis 29 overlap along the edges in the region of the surface of the strand of goods 250, so that a continuous cohesive region of action is created all around. In so doing, the number of jet nozzles 47—as a function of, for example, the diameter of the strand of goods, the goods strand moving speed and the like—can be selected as needed for the respective purpose. The jet nozzles may be conical jet nozzles, fan-jet nozzles, jet nozzles that are curved in the form of a circular arc, or they may also be configured differently to suit the respective purpose in order to generate a uniform region of application or action on the surface of the strand of goods while surrounding said strand of goods.

In the intermediate region or section II adjoining the first section in transport direction 48, shown in FIGS. 4, 4A, the strand of goods 250 passes through a region in which it is subjected only to the application of a transport gas stream exiting from the annular gap 34. In this region, the transfer of the flow energy of the transport gas stream to the strand of goods 250 is optimal, i.e., all around the entire surface of the passing strand of goods, as is obvious from FIG. 4A. Under the influence of the transport gas stream, the distribution of the treatment bath applied in the first section I is further promoted, as is indicated by the axially enlarged annular region of action 61 in FIG. 4. The transport gas stream increases this region of action in axial direction and aids the uniform distribution of the applied treatment agent in the entire strand of goods.

Adjoining the intermediate region or section II, the strand of goods 250 passes through the section III, in which new treatment agent or bath is applied to the strand of goods 250, as is shown by FIGS. 5, 5A. The application of bath, again, takes place via jet nozzles 51 that are uniformly distributed all around the strand of goods in a region of action 62 that encloses the strand of goods in an annular manner. As mentioned previously, the jet direction relative to the transport nozzle axis 29 of the jet nozzles 51 can be adjusted via the ball joints 52, thus also permitting an adjustment of the region of action 62 extending all around the passing strand of goods 250. Referring to the shown exemplary embodiment, the region of action 62 extends, in transport direction 480, all the way into the mixing zone 38, whereby said region of action may extend up to the axial center of said mixing zone 38 or even farther. Regarding the configuration and the number of jet nozzles 51, the same applies as regarding the already explained jet nozzles 47 of the first section I. The jets, which exit from the individual jet nozzles 51 and widen in a fan-like manner, overlap also in this case along their edges in the region of the surface of the passing strand of goods 250.

However it must be noted at this point that, like the jet nozzles in the first section I, the jet nozzles 51 may be irregularly distributed along the circumference in special situations, whereby the arrangement may be such that jet nozzles of different types and different jet configurations may act together. It would also be conceivable that the jet nozzles are not connected to a single bath distributor ring 45 or 49, but that several bath distributor rings may be provided in radially or axially offset fashion in the section I and/or in the section III.

As a result of the combined action with the described divided delivery of the treatment bath to the strand of goods in sections I and III, an optimal transfer of the flow energy of the transport gas stream to the strand of goods in the intermediate section II and a highly favorable distribution of the treatment bath are achieved, whereby—independent of the strand volume—the jet action in two sections causes the strand-shaped goods to be centered on the transport nozzle axis 29.

Upon leaving the mixing zone 38, where the treatment bath streams and the transport gas streams are again internally mixed in the strand of goods, the treated strand of goods enters the diffuser 39. In the diffuser 39, the strand-shaped goods are opened because, due to the increasing cross-section of flow, a reduction of the flow speed of the transport gas stream and of the treatment bath atomized within this transport gas stream occurs, said treatment bath becoming dense by coalescing on the surface of the textile goods.

This process of opening the strand-shaped goods in the diffuser 39 is illustrated in FIGS. 6, 6A, together with the uniform distribution of the treatment bath action resulting from the partial streams of section I and section III of the delivered bath stream.

This process represents an important operative step for the uniformity of the treatment bath application to the moving strand of goods 250. Referring to known systems, the treatment bath not absorbed by the strand of goods, and not carried by the strand of goods, collects in the lower part of the transport zone where it impinges as a bath jet into the goods storage space, so that the strands must be circulated several times for distribution over the entire lot of textile goods. However, referring to the inventive embodiment of the nozzle array 26 and to the inventive method explained above in conjunction with said nozzle array, such compensating times are not required, because, due to the nozzle array 26, an optimal distribution of the treatment bath is achieved in that the inflowing treatment bath, as well as the inflowing transport gas stream, are controlled consistent with the purpose of use of the respectively treated textile goods and the respectively to be performed finishing steps.

FIG. 7 shows a schematic perspective view of the jet pattern with the use of fan-jet nozzles for jet nozzles 47 and/or 51. The flat-jet nozzles, in this case jet nozzles 47, are arranged all round the strand of goods 250. Their individual jet patters enclose the strand of goods, whereby they form a bath film, as it were, all around the strand of goods, and whereby the jet patterns overlap slightly along the edges, or are at least close together, in the region of impingement on the surface of the strand of goods 250. When viewing the vector diagram that is obvious from the jet angle of the jet nozzles 47 in the drawing, it is obvious that the individual jets apply a force component 47*a* acting in transport direction 48 and an inward-acting force component 47*b* to the strand of goods 250. The radially inward-directed force components 47*b* effect, or at least aids, the centering of the strand of goods, whereas the force components 47*a* acting in transport direction contribute to the advance motion of the strand of goods.

Basically, the same is true of the situation in FIG. 8, said Figure showing an example of a modified embodiment of the jet nozzles 47, 51, here again depicting the jet nozzles 47 as an example. Instead of the fan-jet nozzles in accordance with FIG. 7, the jets are depicted with the jet spreading in the form of the segment of an arc. Due to this jet pattern arrangement in the form of a segment of an arc of the individual jet nozzles 47, the jet region enclosing the strand of goods 250 is enlarged in circumferential direction, so that the number of jet nozzles 47 (51) may be reduced. The parabola-like distribution of the treatment bath, in the fan-jet nozzles in accordance with FIG. 7, as well as in the jet nozzles having the form of segments of an arc in accordance with FIG. 8, requires the respective overlap of the edge zones of the jet nozzles of adjacent jet patterns in order to achieve a uniform treatment bath application to the surface of the strand of goods, this having already been pointed out. An adjustment of the optimal jet action, as already previously explained, is achieved by means of the ball joints 48 or 52, whereby this adjustment being an adjustment-constant for operating the nozzle array 26 need not be changed again.

FIG. 9 shows the high-temperature piece dyeing machine in accordance with FIG. 1 with the main control and regulating device, which had been left out in FIG. 1 to avoid confusion, in order to explain the basic sequence of functions in greater detail. Piece goods of natural and synthetic fiber materials existing in the form of strands are processed in such a machine. During treatment, the products, chemicals and dyes required for finishing the textile goods are injected, respectively, in minimal batches, whereby the application to the moving strand of goods occurs as a function of absorption capacity and carrying capacity or based on the respectively pre-specified treatment step. The methods of application are controlled in such a manner that the finishing effects are achieved in a reproducible manner, i.e., with extreme care in handling the goods while maintaining the required quality of goods in view of the level of fastness and the technological values of the piece goods.

The parts that have already been explained with reference to FIG. 1 will not be explained again. Therefore, in FIG. 9, only those reference numbers of FIG. 1 are used which are necessary for the understanding of the function.

The apparatus comprises an electronic control unit 65 that enables the electric motor of the blower unit 15 and the various pumps and valves that are required for operation of the apparatus. At 64, user information, for example regarding the goods to be treated, the formulations and the treatment steps, may be input into the control unit 65, while, an interactive interface is also available to the user. The treatment bath circuit 67 comprises a bath circulating pump 68 and a heat exchanger 69 and leads from the bath collection container 11 to a treatment agent supply conduit 70 from where the transport nozzle arrays 26 of the individual goods storage spaces are supplied with treatment agent. The treatment bath circuit 67 includes a check valve 71 and a bath drain valve 72. Connected to said treatment bath circuit is a pre-formulation/post-formulation container 73 with a metering pump 74. The bypass conduit 76 containing a check valve 75 permits a treatment bath circulation separate from the treatment bath container, as is required for specific treatment steps. Via non-return fittings/control valves 77, 78, the supply lines lead to the bath distributor rings 45, 49, said rings being connected by means of connecting pipes 46 and 50, respectively. Upstream of the deflecting roller 55 on the travel path of the strand of goods there is an additional jet nozzle 79 in the container 1, said nozzle permitting the application of treatment bath to the strand of goods 250 exiting from the goods storage space 2. This additional bath spray-application can be controlled by means of a control valve 80 that is located in a conduit 81 leading away from the treatment agent supply line 70. Furthermore, the supply line for an additional jet nozzle 83 extends from the conduit 81 via a check and control valve, said supply line permitting the additional application of spray to the strand of goods 250 when it enters the goods storage space 2.

The supply of treatment bath to the bath distributor ring 45 of the first section I is controlled by the control valve 77 by pre-specifying the pressure consistent with the characteristic line in the pressure/volume diagram of the jet nozzles. The same applies to the supply of the treatment bath to the second bath distributor ring 49, said supply being appropriately controlled by means of the control valve 78.

The control valve 80 affecting the treatment bath delivery through the additional jet nozzle 79 is used, e.g., in rinsing operations to remove reactive dye stains, i.e., by interaction with the idling pressure roller 56 that is pivoted to abut against the deflecting roller 55. Due to a thusly achieved mechanical removal of fluid adhering to the strand of goods and, in part, of capillary fluid, the treatment bath exchange with the intermediate treatment fluid supplied by the transport nozzle array is improved, so that an accelerated concentration drop of the substances to be rinsed out of the textile goods is achieved and that, as a result of this, rinsing times are shortened and the rinsing water need is reduced.

The control valve 82 is mainly used for the additional application of treatment bath spray to the strand of textile goods that is being cuttled in the goods storage inlet during the wetting phase, i.e., in the case of such products that tend to be initially stiff because of the fibrous material and the weaving structure.

As a function of treatment bath quantity to be applied to the strand of goods 250 moving in the transport nozzle array 26, the bath circulating pump 68 is regulated as the sum of the bath quantities in the first and third sections I and III, respectively, whereby the pressure/volume flow diagram is used to derive the distribution of the jet resolution in the region of the surface of the strand of goods and of the speed ranges of the impinging jet droplets. Corresponding to the vector diagram for the first and third sections I and III, respectively, of the jet action on the strand of goods explained in accordance with FIGS. 7, 8, the axis-parallel speed component in accordance with 47*a* (FIG. 7) being the speed relative to the strand moving speed should not exceed a maximum difference, i.e., as a function of the surface structure and of the sensitivity of the textile goods. The guide value to be used may be a jet pressure, minus the static system pressure of the machine, from 2 to 4 bar. In case that, with the use of highly sensitive textile goods, the admissible mean treatment pressure in the transport nozzle array 26 (pressure in the bath distributor ring 45, 49, is lower than the pressure in an additional treatment bath connecting site in the machine, an additional control device is required in the inflow line 70 to the transport nozzle array 26.

EXEMPLARY EMBODIMENT OF THE METHOD IN ACCORDANCE WITH THE INVENTION

Product:

1. Single-Jersey, 28E/30 Inch,
100% BW knit goods, Nm 50/1, combed.
2. String lining, 20E/26 Inch,
100% BW knit goods, Nm 50/1, combed.
Nm 10/1 as lining thread.

3. 100% PES woven goods, 80 g/m$^2$, width=155 cm.

| | | Product | | |
|---|---|---|---|---|
| | | 1 | 2 | 3 |
| Percentage of fiber | % | 100% CO | 100% CO | 100% PES |
| Hose width | inch | 30 | 26 | |
| Fabric width | cm | | | 155 |
| Weight per unit area | g/m$^2$ | 155 | 295 | 80 |
| Weight per meter | g/m | 260 | 455 | 125 |
| Material thickness | mm | 0.55 | 1.15 | 0.20 |
| Substrate volume $V_S$ per 100 kg | Ltr | 66.7 | 66.7 | 72.5 |
| Textile volume $V_T$ per 100 kg | Ltr | 359 | 390 | 248 |
| Interstice factor E = 1 − $V_S/V_T$ | | 0.814 | 0.829 | 0.708 |

Exemplary Embodiment for Product 1

100% BW knit goods, Nm 50/1

The available Single Jersey is a single-surface smooth product.

For material features, see the table above.

| | |
|---|---|
| Textile goods per 100 kg $V_T$ = | 356 Ltr |
| Substrate volume per 100 kg $V_S$ = | 66.7 Ltr |
| Interstice volume per 100 kg $V_Z$ = | 289 Ltr |
| Specific strand length = | 3.85 m/kg |
| Bath quantity at 100% VZ = | 2.89 l/kg |
| Batch use/storage = | 250 kg |
| Strand length/storage = | 962 m |
| Goods velocity = | 500 m/min |
| Cycle time = | 115 seconds |
| Sum − Draining quantity during cycle time | |
| ($V_Z$100% − $V_Z$80%) × 1.1 = | 0.64 Ltr/kg |
| Textile goods weight/min = | 130 kg/min |
| Bath application = | 113 Ltr/min |
| Bath exchange with contact roller 56 | |
| $V_Z$100% − $V_Z$70% = | 0.867 Ltr/kg |
| Bath application = | 113 Ltr/min |

Referring to the bath delivery to the transport nozzle array 26, the volume flow for the first and second sections is 83.2 Ltr/min. Considering the transport flow of 5 m$^3$/h, the bath pump 62 regulates the rate of revolutions required therefor, said rate of revolutions being lower than the synchronous rate of revolutions of 3000 rpm at 50 Hz used as basis for the 2-phase rotary current motor for converter mode.

Considering the blower motor 19, it is controlled in such a manner that the impeller rate of revolutions is adjusted upward to the pre-specified goods speed, so that the point of operation results as the point of intersection on the characteristic for the intake status with the coordinates for the volume flow in m$^3$/s and for the total pressure increase in mbar. The wave output associated with the characteristic can be used as the guide value for the volume flow.

Exemplary Embodiment Regarding Product 2

100% BW knit goods, Nm 50/1 and Nm 10/1, as liner thread for the string liner product For material features, see the table above.

| | |
|---|---|
| Textile goods volume per 100 kg$V_T$ = | 390 Ltr |
| Substrate volume per 100 kg$V_S$ = | 66.7 Ltr |
| Interstice volume per 100 kg$V_Z$ = | 323 Ltr |
| Specific strand length = | 2.20 m/kg |
| Bath quantity at 100% VZ = | 3.23 l/kg |
| Batch use/storage = | 250 kg |
| Strand length/storage = | 550 m |
| Goods velocity = | 300 m/min |
| Cycle time = | 110 seconds |
| Sum − Draining quantity during cycle time | |
| ($V_Z$100% − $V_Z$80%) × 1.1 = | 0.715 Ltr/kg |
| Textile goods weight/min = | 136 kg/min |
| Bath application = | 97.24 Ltr/min |
| Bath change with contact roller 56 | |
| $V_Z$100% − $V_Z$70% = | 0.96 Ltr/kg |
| Bath application = | 130.56 Ltr/min |

Referring to the bath delivery in the transport nozzle arrangement 26, the volume flow for the first and the second sections is 97.24 Ltr/min; or, for the transport flow of 5.83 m$^3$/h, the control of the bath pump 68 is achieved analogously as is described in conjunction with Product 1.

This also applies to the control of the blower 15 with respect to the goods velocity of 300 m/min.

Exemplary Embodiment Regarding Product 3

100% PES woven goods, 80 g/m$^2$ and material width of 155 cm.

For material features, see the table above.

| | |
|---|---|
| Textile goods volume per 100 kg $V_T$ = | 248 Ltr |
| Substrate volume per 100 kg $V_S$ = | 72.5 Ltr |
| Interstice volume per 100 kg $V_Z$ = | 175.5 Ltr |
| Specific strand length = | 8.0 m/kg |
| Bath quantity at 100% VZ = | 1.75 l/kg |
| Batch use/storage = | 180 kg |
| Strand length/storage = | 1440 m |
| Goods velocity = | 700 m/min |
| Cycle time = | 123 seconds |
| Sum − Draining quantity during cycle interval | |
| ($V_Z$100% − $V_Z$80%) × 1.1 = | 0.484 Ltr/kg |
| Textile goods weight/min = | 87.5 kg/min |
| Bath application = | 42.35 Ltr/min |
| Batch change with contact roller 56 | |
| $V_Z$100% − $V_Z$70% = | 0.61 Ltr/kg |
| Bath application = | 53.8 Ltr/min |

Referring to the bath delivery in the transport nozzle arrangement 26, the volume flow for the first and the second sections is 42.35 Ltr/min. For the transport flow of 3.27 m$^3$/h, the control of the bath pump 68 is achieved analogously as described in conjunction with Products 1 and 2.

This also applies to the adjustment of the blower 15 to a goods velocity of 700 m/min.

FIGS. 10, 11 show an embodiment of the transport nozzle array 26 in accordance with FIG. 2, whereby the outer nozzle formed part 33 is arranged so as to be axially shiftable. The same parts have the same reference numbers as in FIG. 2 and are not explained again.

As already mentioned, the jet nozzles 51 are connected to the bath distributor ring 49 of the third section III via ball joints 52. The bath distributor ring 49 is connected to the outer nozzle formed part 22 via struts 500, so that—as a result of an axial shift of the bath distributor ring 49—the outer nozzle formed part can be shifted out of the shown position into the position shown in dashed lines in FIG. 10. In so doing, the jet width of the transport gas steam exiting from the annular gap 34 can—depending on blower output and textile goods/product spectrum—be properly adjusted by axially shifting the outer nozzle formed part 33, as a rule, as a one-time adjustment. Inasmuch as the goods strand velocity is a function of the action of the transport gas stream reaching the strand of goods, changing operating conditions that are a function of the respective status of the gas in the container 1 can be taken into consideration with reference to the characteristic of the blower unit 15.

The axial adjustment of the outer nozzle formed part 33 is achieved via actuators that are not specifically shown in the Figure, said actuators—on the connecting part 50—acting on axial actuation members of the bath distributor ring 49. Optionally, the actuators may be enabled by the control unit 65 (FIG. 9).

In order to change the jet angle subtended by the jet nozzles 51 and the transport nozzle axis 29, an actuating mechanism is provided which comprises a conical annular tray 85 that is supported so that it can be shifted parallel to the transport nozzle axis 29 via two adjustment pins that are offset relative to each other by 180° and sealed by the annular plate 24. Via a double-arm lever 88 that is pivotably supported at 87, the adjustment pins 86 are coupled with an adjustment spindle 89 that is supported on the annular plate 24, said spindle permitting the axial adjustment of the conical annular tray 85. The jet nozzles 51 are mounted to the conical annular tray 85 by means of a connector 90, i.e., in such a manner that, when the annular tray 85 is adjusted in axial direction, the connector 90 on the threaded connector piece of the respective jet nozzle 51 is shifted.

Referring to the selected exemplary embodiment, the jet angle range available to the jet nozzles 51 has a jet angle without an angle deflection of 45° and can be adjusted therefor in an angular range of respectively 30° max., this being adjustable corresponding to a jet angle with respect to the transport nozzle axis 29 of 75° to 15°. FIG. 12 shows, again in a schematic view, the spray ranges of the individual jet nozzles 51 that are distributed uniformly all around the strand of goods 250. This depiction shows that the spray ranges overlap in the edge zones and, overall, completely enclose the strand of goods 250 on all sides.

The jet nozzles 47, 51 associated with the two sections I and III are shielded against the transport gas stream by the inflow nozzle formed part 28 and the outer nozzle formed part 33, respectively. These shields may have, in at least one of the sections I, III, bypass orifices through which the gaseous transport medium may flow in order to rinse the jet nozzles 47 and 51, respectively. Such a bypass orifice is indicated, e.g., at 92 and 93, respectively.

Finally, it should be mentioned that the jet angles that include the jet nozzles 47, 51 in the first and second sections I and III, respectively, may be the same or different from each other. In particular, in section I, the jet nozzles 47 may display a jet angle which is essentially the same as the delivered flow angle at which the transport air stream exiting from the annular gap 34 flows at the strand of goods 250.

The invention claimed is:

1. Apparatus for wet-processing strand-shaped textile goods, said apparatus comprising a closed container, comprising a transport nozzle array to which a gaseous transport medium can be supplied, said gaseous transport medium transporting the textile goods having the form of a strand of goods through the transport nozzle array and through said container in a transport direction, and comprising a device for applying a liquid treatment agent in atomized form to the moving strand of goods in the region of the transport nozzle arrangement, whereby the device for the application of the treatment agent is designed to apply the treatment agent to the strand of goods in two sections (I; III), which are at a distance from each other in transport direction of the strand of goods, in a form enclosing the strand of goods at least partially in ring-shaped manner, and whereby, in an immediate region (II) located between the two sections, the gaseous transport medium is applied to the strand of goods.

2. The apparatus in accordance with claim 1, wherein the transport nozzle array comprises a Venturi transport nozzle having a nozzle axis and an annular nozzle gap to which can be delivered a transport medium, and that of the two sections (I; II), respectively viewed in transport direction of the strand of goods, a first section (I) is provided in front of the annular gap and a second section (II) is provided behind the annular nozzle gap.

3. The apparatus in accordance with claim 2, wherein jet nozzles for the treatment agent are associated with the two sections (I; II), respectively, each of said nozzles being used to apply a pre-specified volume flow at a pre-specified jet angle to the strand of goods.

4. The apparatus in accordance with claim 3, wherein the jet nozzles associated with the two sections (I; III) have supply devices for the treatment agent, said devices being divided from each other.

5. The apparatus in accordance with claim 4, wherein the treatment agent jets produced by the individual jet nozzles generate, on the strand of goods, radial force components acting on said strand of goods and pointing in transport direction, said jets being appropriately aligned relative to the transport nozzle direction and being delivered at appropriate treatment agent flow volumes when impinging on the surface of the goods strand, and that the strand of goods is centered by the radial force components relative to the transport nozzle axis.

6. The apparatus in accordance with claim 3, wherein the jet nozzles associated with the two sections (I; III) are aligned so as to have the same jet angle relative to the transport nozzle axis.

7. The apparatus in accordance with claim 3, wherein the jet nozzles associated with the two sections (I; III) are aligned so as to have different jet angles relative to the transport nozzle axis.

8. The apparatus in accordance with claim 3, wherein the jet angle that is subtended by the jet nozzles and the transport nozzle axis is within a range of 23° and 15° in the first section (I).

9. The apparatus in accordance with claim 3, wherein, in at least one of the two sections (I; III), the jet nozzles are arranged so as to be distributed all around the transport nozzle axis.

10. The apparatus in accordance with claim 9, wherein each of the jet nozzles is connected to a common closed circular line for the supply of the treatment agent.

11. The apparatus in accordance with claim 9, wherein the jet nozzles are arranged so as to be uniformly distributed all around the transport nozzle axis.

12. The apparatus in accordance with claim 9, wherein the jet nozzles are arranged all around the transport nozzle axis at such a distance from each other in circumferential direction and at such a radial distance from the transport nozzle axis and under such a jet angle that an overlap of the treatment agent jets exiting from the individual nozzles results in the regions of their impingement on the surface of the strand of goods.

13. The apparatus in accordance with claim 3, wherein the jet nozzles are full-cone nozzles or fan-jet nozzles.

14. The apparatus in accordance with claim 3, wherein the jet nozzles are curved in the shape of an arc.

15. The apparatus in accordance with claim 3, wherein the jet nozzles associated with the two sections (I; III) are arranged so as to be shielded against the transport medium, and that the shields have bypass orifices in at least one section, through which the gaseous transport medium may flow in order to rinse the jet nozzles.

16. The apparatus in accordance with claim 2, wherein each of the jet axes of the jet nozzles is provided so as to at least allow the adjustment of their angular position relative to the transport nozzle axis.

17. The apparatus in accordance with claim 2, wherein the transport nozzle has, located in the intermediate region (II) between the two sections (I; III), guide means for the transport medium, said guide means limiting the annular nozzle gap at least on one side and defining the jet width and the angle of impingement of the transport medium on the passing strand of goods.

18. The apparatus in accordance with claim 17, wherein the guide means are adjustable.

19. The apparatus in accordance with claim 18, wherein at least the guide channel wall limiting the second section (II) is configured so as to be axially adjustable in order to change the guide channel width.

20. The apparatus in accordance with claim 17, wherein the guide means have a centrically formed guide channel for delivery of the transport agent stream to the strand of goods, whereby the walls of said guide channel limit the first section (I) on the inlet side of the strand of goods in the transport nozzle and limit the second section (II) on the outlet side of the strand of goods.

21. The apparatus in accordance with claim 20, wherein the angle of impingement of the transport medium defined by the guide channel, said angle being relative to the transport nozzle axis, is equal to the jet angle of the jet nozzles of at least the second section.

22. The apparatus in accordance with the claim 20, wherein the angle of impingement defined by the guide channel, said angle being relative to the transport 25 nozzle axis, is smaller than the jet angle of the jet nozzles of at least the third section (III).

23. The apparatus in accordance with claim 2, wherein a cylindrical mixing zone having a pre-specified length adjoins the third section (III) of the transport nozzle, viewed in transport direction.

24. The apparatus in accordance with claim 23, wherein a diffuser is arranged downstream of the mixing zone, and that the passage surface for the strand of goods and the transport medium is smaller at the diffuser outlet than the corresponding passage surface of a transport zone adjoining the latter.

25. A method for wet-processing strand-shaped textile goods, said method being used to move the strand of goods through a transport nozzle array to which a gaseous transport medium is supplied, said strand of goods being transported in said transport nozzle array in one direction of transport, and said method comprising the following steps:

during passage through the transport nozzle array, atomized liquid treatment agent is applied to the moving strand of goods in two divided sections, which are at a distance from each other in transport direction, in a form that at least partially encloses the strand of goods, and, at the same time, a transport medium is applied to the strand of goods in an intermediate region located between said two sections, said transport medium effecting the advance of the strand of goods.

26. The method in accordance with claim 25, wherein the transport nozzle array comprises a Venturi transport nozzle with an annular gap, the transport medium flowing through said annular gap, and that of the two sections, respectively viewed in transport direction, a first section is provided in front of the annular gap and a second section is provided behind the annular gap.

27. The method in accordance with claim 26, wherein the treatment agent is applied via jet nozzles which are arranged so as to enclose the strand of goods in at least one of the sections in a ring-shaped manner.

28. The method in accordance with claim 27, wherein the jet angle subtended by the respective jet nozzle axis and the transport axis can be adjusted.

* * * * *